US007497254B2

(12) United States Patent
Hall et al.

(10) Patent No.: US 7,497,254 B2
(45) Date of Patent: Mar. 3, 2009

(54) POCKET FOR A DOWNHOLE TOOL STRING COMPONENT

(76) Inventors: David R. Hall, 2185 S. Larsen Pkwy., Provo, UT (US) 84606; Paula Turner, 2185 S. Larsen Pkwy., Provo, UT (US) 84606; Nathan Nelson, 2185 S. Larsen Pkwy., Provo, UT (US) 84606; Daryl Wise, 2185 S. Larsen Pkwy., Provo, UT (US) 84606

( * ) Notice: Subject to any disclaimer, the term of this patent is extended or adjusted under 35 U.S.C. 154(b) by 170 days.

(21) Appl. No.: 11/688,952

(22) Filed: Mar. 21, 2007

(65) Prior Publication Data

US 2008/0230277 A1 Sep. 25, 2008

(51) Int. Cl.
*E21B 43/00* (2006.01)

(52) U.S. Cl. ..... 166/65.1; 166/242.6

(58) Field of Classification Search ..... 166/65.1, 166/242.6; 175/320
See application file for complete search history.

(56) References Cited

U.S. PATENT DOCUMENTS

| | | | |
|---|---|---|---|
| 1,817,772 | A | 8/1931 | Sipe |
| 1,977,175 | A | 10/1934 | Davis |
| 2,066,473 | A | 1/1937 | Jorgensen |
| 2,325,811 | A | 8/1943 | Terrell |
| 2,354,887 | A | 8/1944 | Silverman |
| 2,664,272 | A | 12/1953 | Boice |
| 2,676,820 | A | 4/1954 | Boice |
| 2,999,552 | A | 9/1961 | Fox |
| 3,079,549 | A | 2/1963 | Martin |
| 3,085,939 | A | 4/1963 | Fitch |
| 3,125,173 | A | 3/1964 | Fox |
| 3,146,611 | A | 9/1964 | Fox |
| 3,175,374 | A | 3/1965 | Toelke |
| 3,186,222 | A | 6/1965 | Martin |
| 3,194,331 | A | 7/1965 | Arnold |
| 3,338,069 | A | 8/1967 | Ortloff |
| 3,360,960 | A | 1/1968 | Massey |
| 3,554,307 | A | 1/1971 | Yount |
| 3,606,402 | A | 9/1971 | Medney |
| 3,773,359 | A | 11/1973 | Chance |
| 3,793,632 | A | 2/1974 | Still |
| 3,876,972 | A | 4/1975 | Garrett |
| 3,903,974 | A | 9/1975 | Cullen |
| 3,968,473 | A | 7/1976 | Patton |
| 4,204,707 | A | 5/1980 | Lincicome |
| 4,215,426 | A | 7/1980 | Klatt |
| 4,328,704 | A | 5/1982 | Arpasi |
| 4,365,678 | A | 12/1982 | Fitch |
| 4,460,202 | A | 7/1984 | Chance |

(Continued)

*Primary Examiner*—William P Neuder
(74) *Attorney, Agent, or Firm*—Tyson J. Wilde; Benjamin T. Miskin

(57) ABSTRACT

A downhole tool string component, having a tubular body with an outer diameter. A first, second, and third flange are disposed around the outer diameter of the tubular body at different axial locations. A first sleeve is disposed around the tubular body such that opposite ends of the first sleeve fit around at least a portion of the first and second flanges, forming a first sealed pocket around the outer diameter of the tubular body. A second sleeve is disposed around the tubular body such that opposite ends of the second sleeve fit around at least a portion of the second and third flanges, forming a second sealed pocket around the outer diameter of the tubular body.

17 Claims, 11 Drawing Sheets

U.S. PATENT DOCUMENTS 4,479,564 A 10/1984 Tanguy
4,683,944 A 8/1987 Curlett
4,722,402 A 2/1988 Weldon
4,785,247 A 11/1988 Meador
4,811,597 A 3/1989 Hebel
4,811,800 A 3/1989 Hill
4,892,337 A 1/1990 Gunderson
5,039,137 A 8/1991 Cankovic
5,040,620 A 8/1991 Nunley
5,040,622 A 8/1991 Winship
5,248,857 A 9/1993 Ollivier
5,334,801 A 8/1994 Mohn
5,343,949 A * 9/1994 Ross et al. ..... 166/278
5,691,712 A 11/1997 Meek
5,988,276 A 11/1999 Oneal
6,012,744 A 1/2000 Wilson
6,026,897 A 2/2000 Pringle
6,619,392 B2 * 9/2003 Marangoni et al. ..... 166/243
6,655,452 B2 12/2003 Zillinger
6,666,274 B2 * 12/2003 Hughes ..... 166/385
6,851,489 B2 2/2005 Hinds
6,896,049 B2 5/2005 Moyes
6,983,796 B2 * 1/2006 Bayne et al. ..... 166/278
2003/0070842 A1 4/2003 Bailey
2004/0067002 A1 * 4/2004 Berg et al. ..... 385/12
2004/0184871 A1 9/2004 Luft

* cited by examiner

POCKET FOR A DOWNHOLE TOOL STRING COMPONENT

BACKGROUND OF THE INVENTION

Advances in downhole telemetry systems have enable high speed communication between downhole devices and the earth's surface. With these high speed communication abilities, more downhole devices may be utilized in downhole applications. Harsh downhole environments may subject downhole devices to extreme temperatures and pressures. Further, drilling and/or production equipment may apply potentially damaging forces to the downhole devices, such as tensile loads of a drill string, compression and tension from bending, thermal expansion, vibration, and torque from the rotation of a drill string.

U.S. Pat. No. 6,443,226 by Diener et al., which is herein incorporated by reference for all that it contains, discloses an apparatus for protecting sensing devices disposed on an outer surface of a pipe. The apparatus includes a housing and a plurality of bumpers. The housing is attached to the outer surface of the pipe. The bumpers are attached to one of the outer surface of the pipe or the housing. Each bumper includes a post and a bumper pad. The bumpers are enclosed within the region formed between the housing and the pipe.

U.S. Pat. No. 6,075,461 by Smith, which is herein incorporated by reference for all that it contains, discloses an apparatus, method and system for communicating information between downhole equipment and surface equipment. An electromagnetic signal repeater apparatus comprises a housing that is securably mountable to the exterior of a pipe string disposed in a well bore. The housing includes first and second housing subassemblies. The first housing subassembly is electrically isolated from the second housing subassembly by a gap subassembly having a length that is at least two times the diameter of the housing. The first housing subassembly is electrically isolated from the pipe string and is secured thereto with a nonconductive strap. The second housing subassembly is electrically coupled with the pipe string and is secured thereto with a conductive strap. An electronics package and a battery are disposed within the housing. The electronics package receives, processes, and retransmits the information being communicated between the downhole equipment and the surface equipment via electromagnetic waves.

U.S. Pat. No. 6,655,452 by Zillinger, which is herein incorporated by reference for all that it contains, discloses a carrier apparatus for connection with a pipe string for use in transporting at least one gauge downhole through a borehole. The apparatus includes a tubular body for connection with the pipe string having a bore for conducting a fluid therethrough and an outer surface, wherein the outer surface has at least one longitudinal recess formed therein. Further, at least one insert defining an internal chamber for receiving a gauge is mounted with the body such that at least a portion of the insert is receivable within the recess for engagement therewith. The apparatus also includes an interlocking interface comprised of the engagement between the insert and the recess, wherein the interlocking interface is configured such that the insert inhibits radial expansion of the body adjacent the recess.

BRIEF SUMMARY OF THE INVENTION

In one aspect of the present invention a downhole tool string component has a tubular body with an outer diameter. A first, second, and third flange are disposed around the outer diameter of the tubular body at different axial locations. A first sleeve is disposed around the tubular body such that opposite ends of the first sleeve connect to at least a portion of the first and second flanges. A second sleeve is disposed around the tubular body such that opposite ends of the second sleeve connect at least a portion of the second and third flanges. At least one sleeve forms a pocket around the outer diameter of the tubular body.

The sleeves may comprise a plurality of grooves adapted to allow the sleeves to stretch and/or flex with the tubular body. The first and second sleeves may be interlocked. The sleeves may be interlocked with a castle cut connection. The first sleeve abuts a shoulder formed in the outer diameter of the downhole component. At least one sleeve may be made of a non-magnetic material. At least one flange and at least one sleeve may be a single element. An end of at least one sleeve may fit around a portion of at least one flange.

The first pocket may be electrically connected to a second pocket formed around the outer diameter of the tubular body by the second sleeve. The pockets may be electrically connected through an electrically conductive conduit disposed within the second flange. At least one pocket may be sealed. The flanges may comprise o-rings disposed along an outer diameter of the flanges. The flanges may comprise o-rings disposed along an inner diameter of the flanges.

An electronics housing may be disposed within at least one of the pockets. The electronics housing may be interlocked with at least one flange. The electronics housing may be interlocked with the flange using pins. The electronics housing may be interlocked with the tubular body.

The component may also comprise a collar disposed around the tubular body at an end and adapted to be a primary shoulder of the component. At least one sleeve may be a stabilizer adapted to stabilize the component in a well bore. The component may comprise a third sleeve disposed around the tubular body such that opposite ends of the third sleeve connect to at least a portion of the third flange and a fourth flange, forming another pocket around the outer diameter of the tubular body. The third sleeve may comprise openings adapted to allow fluid to pass through the sleeve.

DETAILED DESCRIPTION OF THE INVENTION AND THE PREFERRED EMBODIMENT

Figure 1:
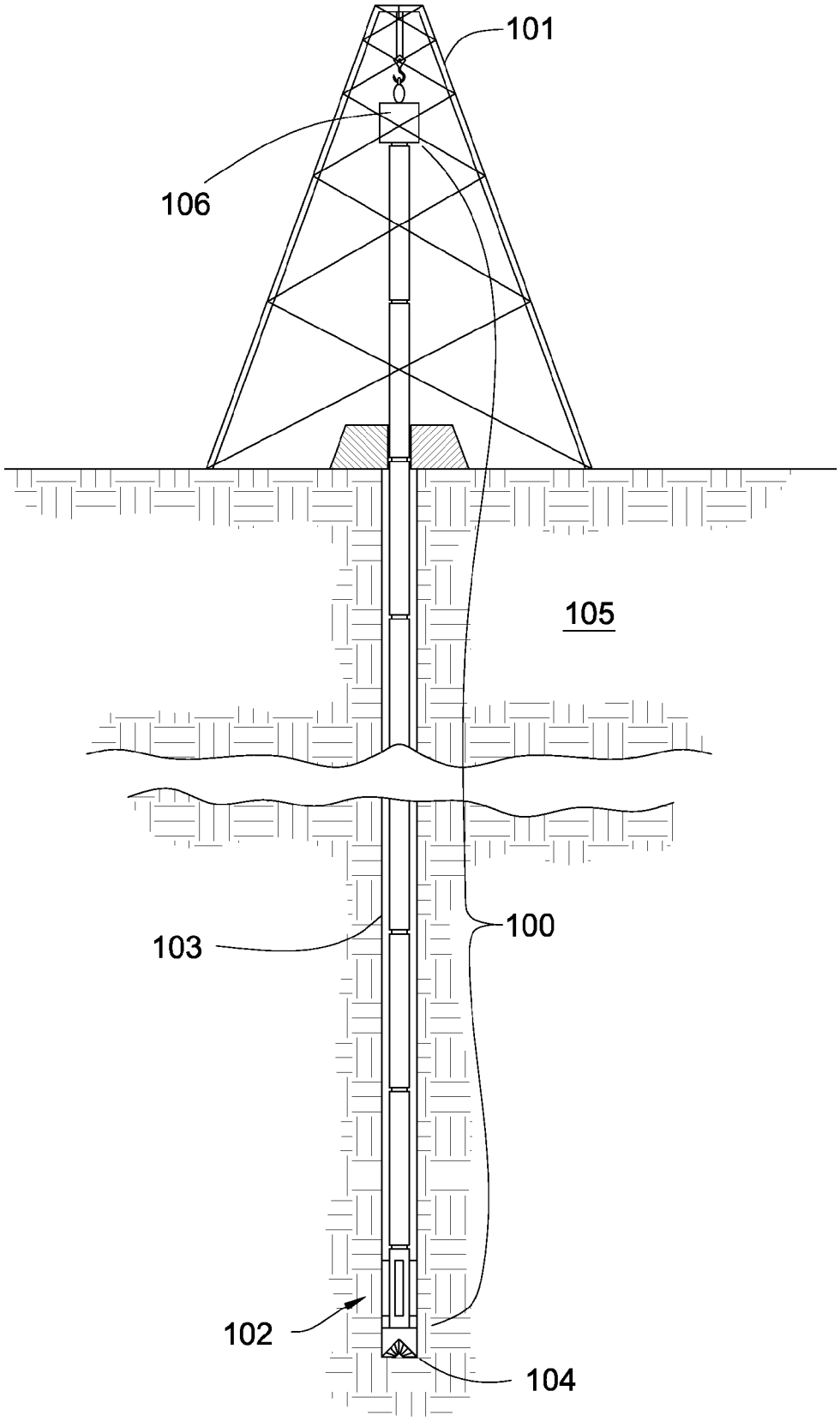
FIG. 1 is a cross-sectional diagram of an embodiment of a drill string suspended in a bore hole.

FIG. 1 is an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. A preferred data transmission system is disclosed in U.S. Pat. No. 6,670,880 to Hall, which is herein incorporated by reference for all that it discloses. However, in some embodiments, no telemetry system to the surface is required. Mud pulse, short hop, or EM telemetry systems, or wired pipe may also be used with the present invention.

Figure 2:
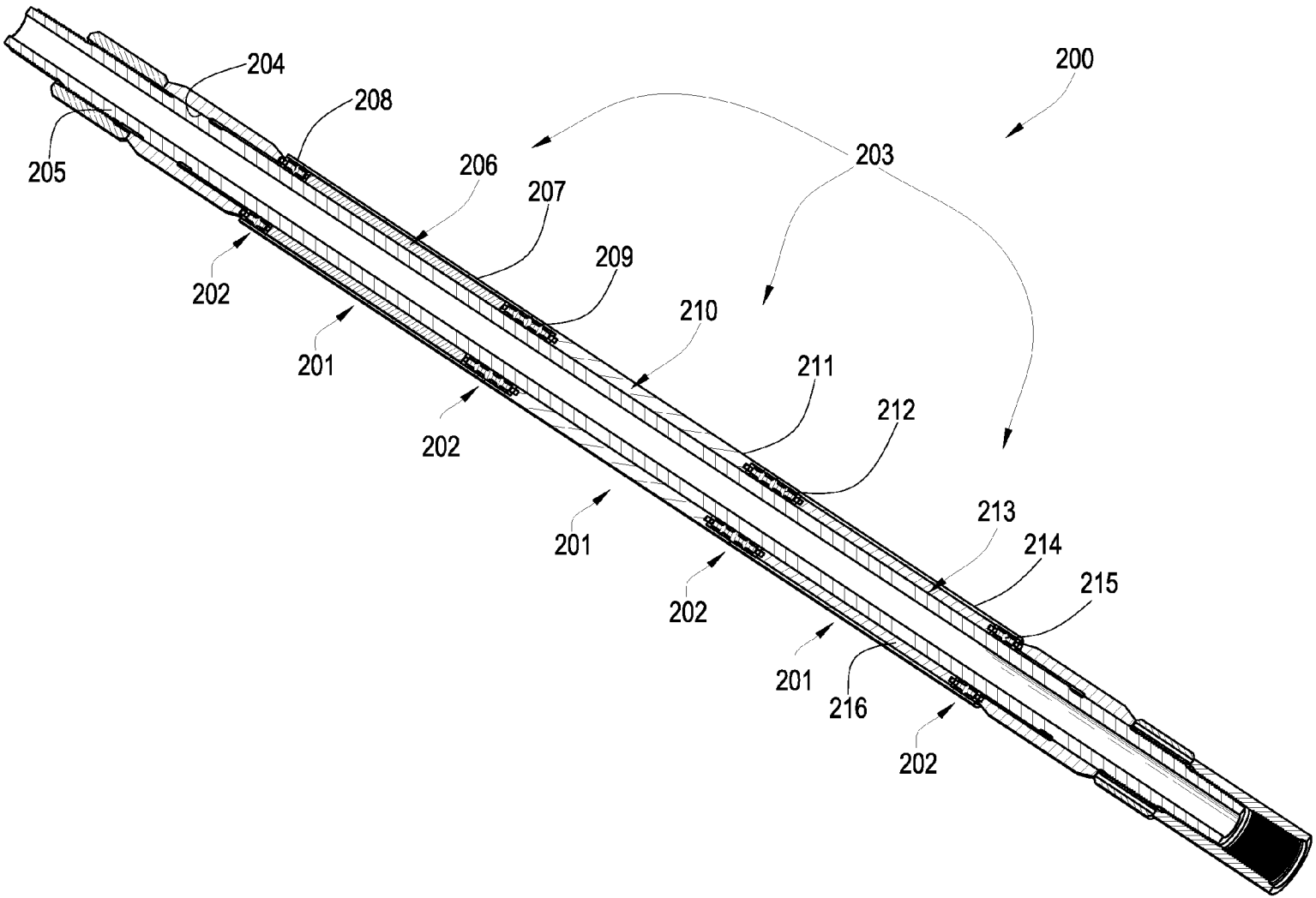
FIG. 2 is a cross-sectional diagram of an embodiment of a downhole tool string component.

A downhole tool string component 200 in the drill string 100 may comprise a plurality of pockets 201, as in the embodiment of FIG. 2. The pockets 201 are formed by a plurality of flanges 202 disposed around the component 200 at different axial locations and covered by individual sleeves 203 disposed between and around the flanges 202. A first pocket 206 may be formed around an outer diameter 204 of a tubular body 205 by a first sleeve 207 disposed around the tubular body 205 such that opposite ends of the first sleeve 207 fit around at least a portion of a first flange 208 and a second flange 209. A second pocket 210 may be formed around the outer diameter 204 of the tubular body 205 by a second sleeve 211 disposed around the tubular body 205 such that opposite ends of the second sleeve fit 211 around at least a portion of the second flange 209 and a third flange 212. A third pocket 213 may also be formed around the outer diameter 204 of the tubular body 205 by a third sleeve 214 disposed around the tubular body 205 such that opposite ends of the third sleeve 214 fit around at least a portion of the third flange 212 and a fourth flange 215. The sleeves 203 may be interlocked or keyed together near the flanges 202 for extra torsional support.

The individual sleeves 203 may allow for better axial and torsional flexibility of the component 200 than if the component 200 comprised a single sleeve spanning the pockets 201. The sleeves 203 may also comprise a plurality of grooves adapted to allow the sleeves 203 to stretch and/or flex with the tubular body 205. At least one sleeve may be made of a non-magnetic material, which may be useful in embodiments using magnetic sensors or other electronics. The pockets 201 may be sealed, though a sleeve and the pocket may comprise openings adapted to allow fluid to pass through the sleeve such that one of the pockets is a wet pocket.

Electronic equipment may be disposed within at least one of the pockets of the tool string component. The electronics may be in electrical communication with the aforementioned telemetry system, or they may be part of a closed-loop system downhole. An electronics housing 216 may be disposed within at least one of the pockets wherein the electronic equipment may be disposed, which may protect the equipment from downhole conditions. The electronics may comprise sensors for monitoring downhole conditions. The sensors may include pressure sensors, strain sensors, flow sensors, acoustic sensors, temperature sensors, torque sensors, position sensors, vibration sensors, geophones, hydrophones, electrical potential sensors, nuclear sensors, or any combination thereof. Information gathered from the sensors may be used either by an operator at the surface or by the closed-loop system downhole for modifications during the drilling process. If electronics are disposed in more than one pocket, the pockets may be in electrical communication which may be through an electrically conductive conduit disposed within the flange separating them.

Figure 3:
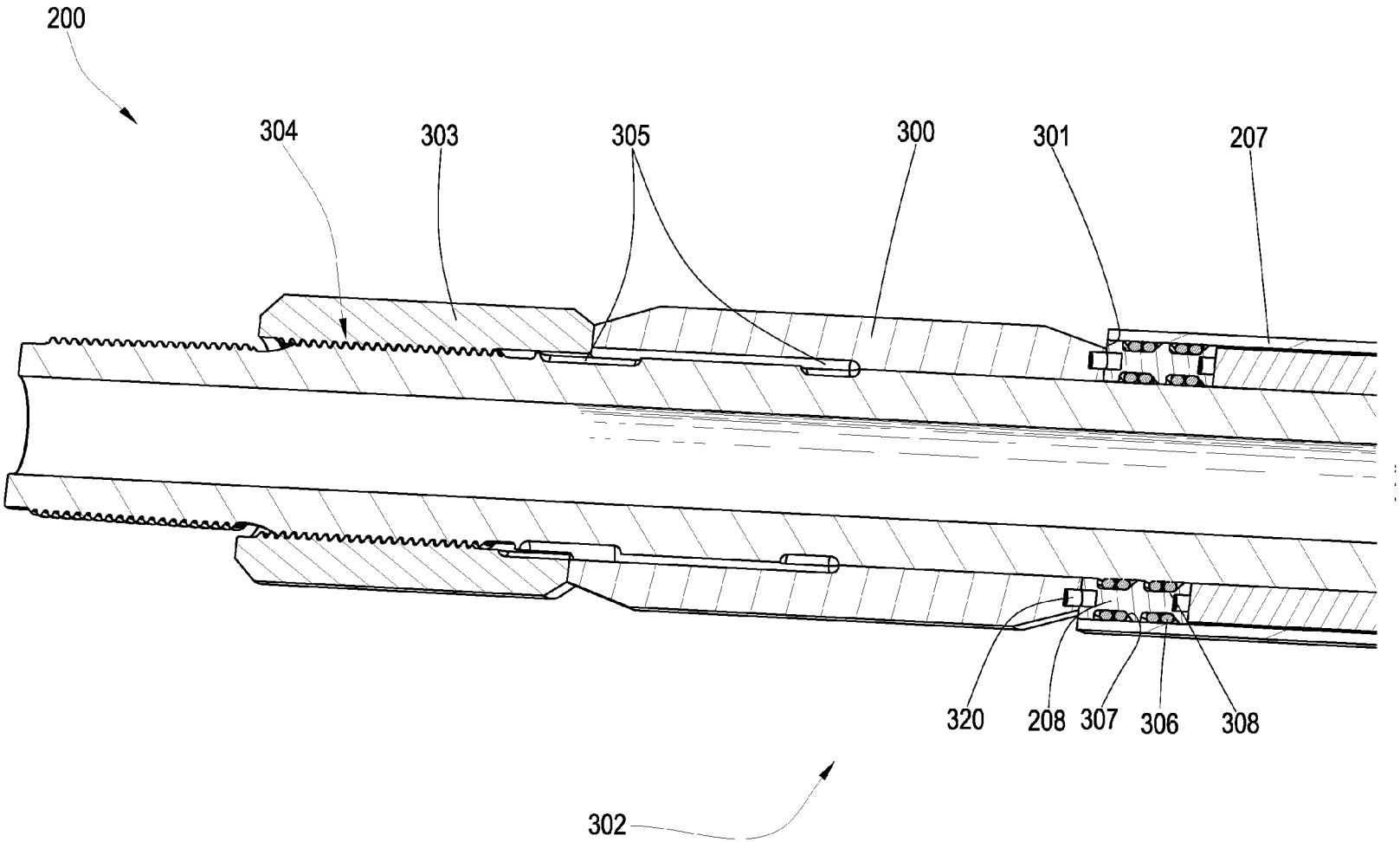
FIG. 3 is a cross-sectional diagram of another embodiment of a downhole tool string component.

The first flange 208 may abut a first shoulder collar 300 disposed around the tubular body at a first end 302 of the tool string component 200 adapted to be a primary shoulder 301 of the component, as in the embodiment of FIG. 3. The primary shoulder 301 may provide strength and stability for the component while downhole and may prevent the sleeves 203 and flanges 202 from experiencing axial movement with respect to the component. The first shoulder collar 300 may be supported by a first left-threaded collar 303, which may be disposed around the first end 302 on a left-threaded portion 304 of the component. The left-threaded collar 303 may be keyed to the component with pins 305 in order to keep the left-threaded collar 303 axially stationary and to provide axial support to the first shoulder collar 300.

The component 200 may be assembled at the drill site. The first shoulder collar 300 may be keyed to the component by a plurality of pins 305. The left-threaded collar 303 may be disposed around the component before the first shoulder collar 300 during assembly. After the left-threaded collar 303 is threaded on the component, the first shoulder collar 300 may then be slid into position from the opposite end of the component 200 over the plurality of pins 305 which keys the component to the component.

The flanges 202 may then be placed around the component, with the first flange 208 being keyed to the primary shoulder 301, possibly by another plurality of pins 320, in order to keep the first flange 208 rotationally stationary and provide torsional support. The flanges 202 may comprise o-rings 306 disposed around an outer diameter 307 of the flanges and/or within an inner diameter 308 of the flanges 202, such that the pockets 201 may be sealed when the sleeves 203 are placed around the component. The first sleeve 207 may abut a portion of the primary shoulder 301.

The component may also be pre-assembled prior to shipping to the drill site. In such embodiments, the sleeves may be press fit around the flanges. A grit may be placed into the press fit such that the grit may gall the surfaces of the flange and sleeve in order to create more friction between the two surfaces, wherein a stronger connection is made.

Figure 4:
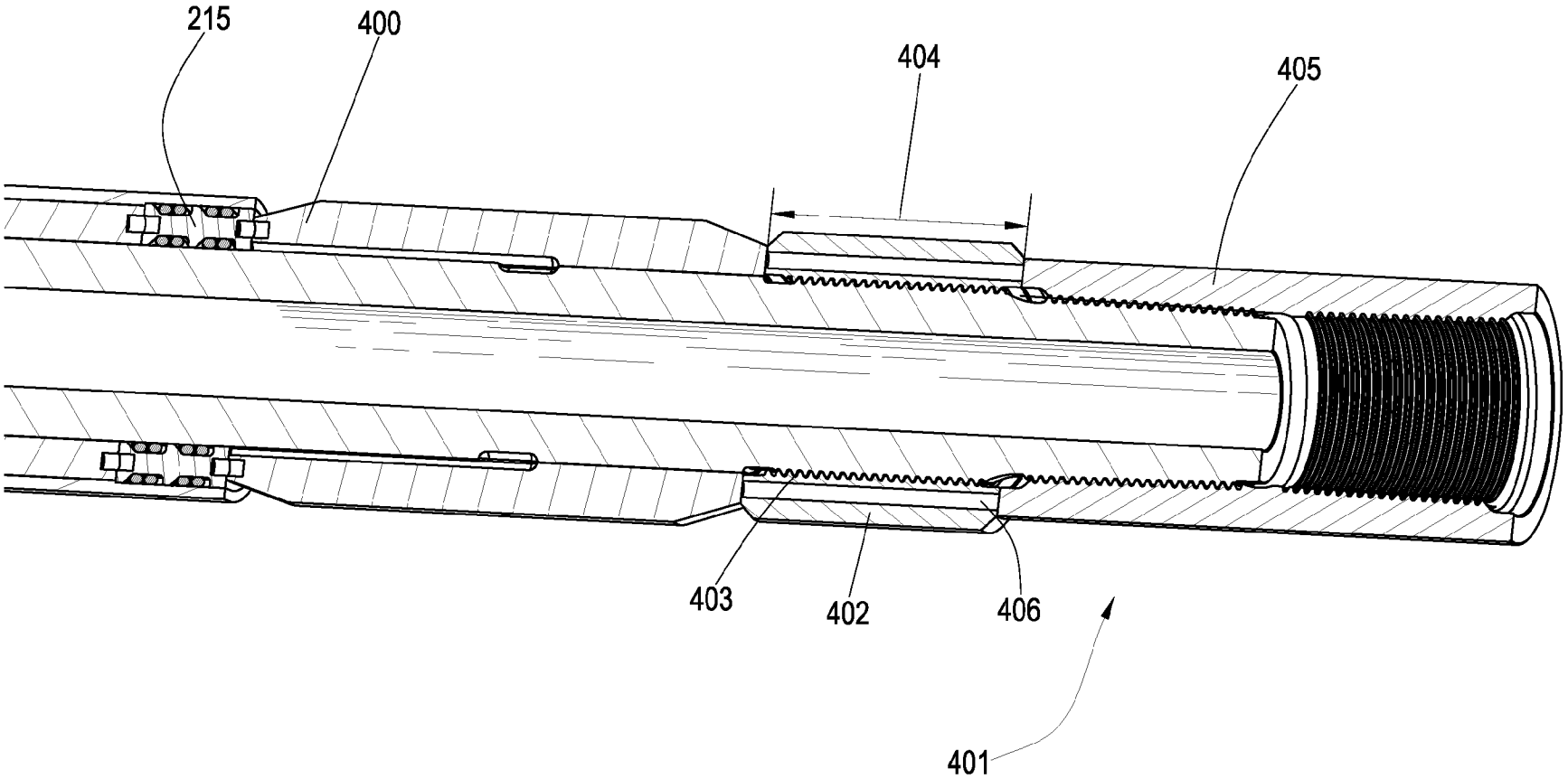
FIG. 4 is a cross-sectional diagram of another embodiment of a downhole tool string component.

The fourth flange 215 on the component 200 may be keyed to a second shoulder collar 400 placed around a second end 401 of the component, as in the embodiment of FIG. 4. The second shoulder collar 400 may also be keyed to the component in order to provide torsional support to the sleeves 203 and electronic equipment. A second left-threaded collar 402 may also be threaded onto a left-threaded portion 403 at the second end 401 of the component and keyed to the component to prevent axial displacement of other elements around the component. The second left-threaded collar 402 may be keyed to the second shoulder collar 400 by drilling holes 406 through a length 404 of the second left-threaded collar 402 and into the second shoulder collar 400 wherein pins 305 may be inserted. A female-female connector 405 may be threaded onto the second end 401 of the component such that the component comprises a box end and a pin end for linking multiple components together.

Figure 5:
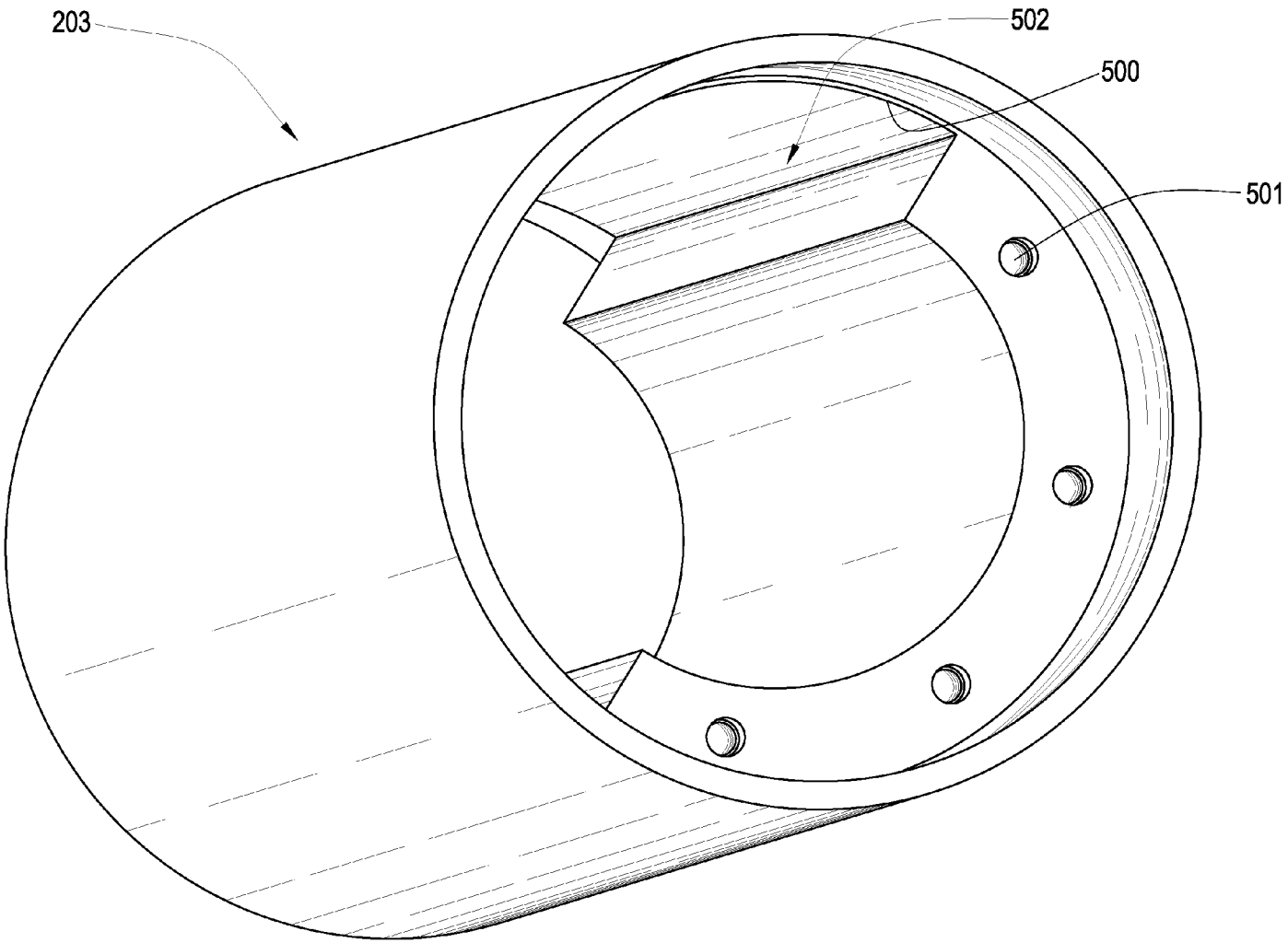
FIG. 5 is a perspective diagram of an embodiment of a flange.
Figure 6:
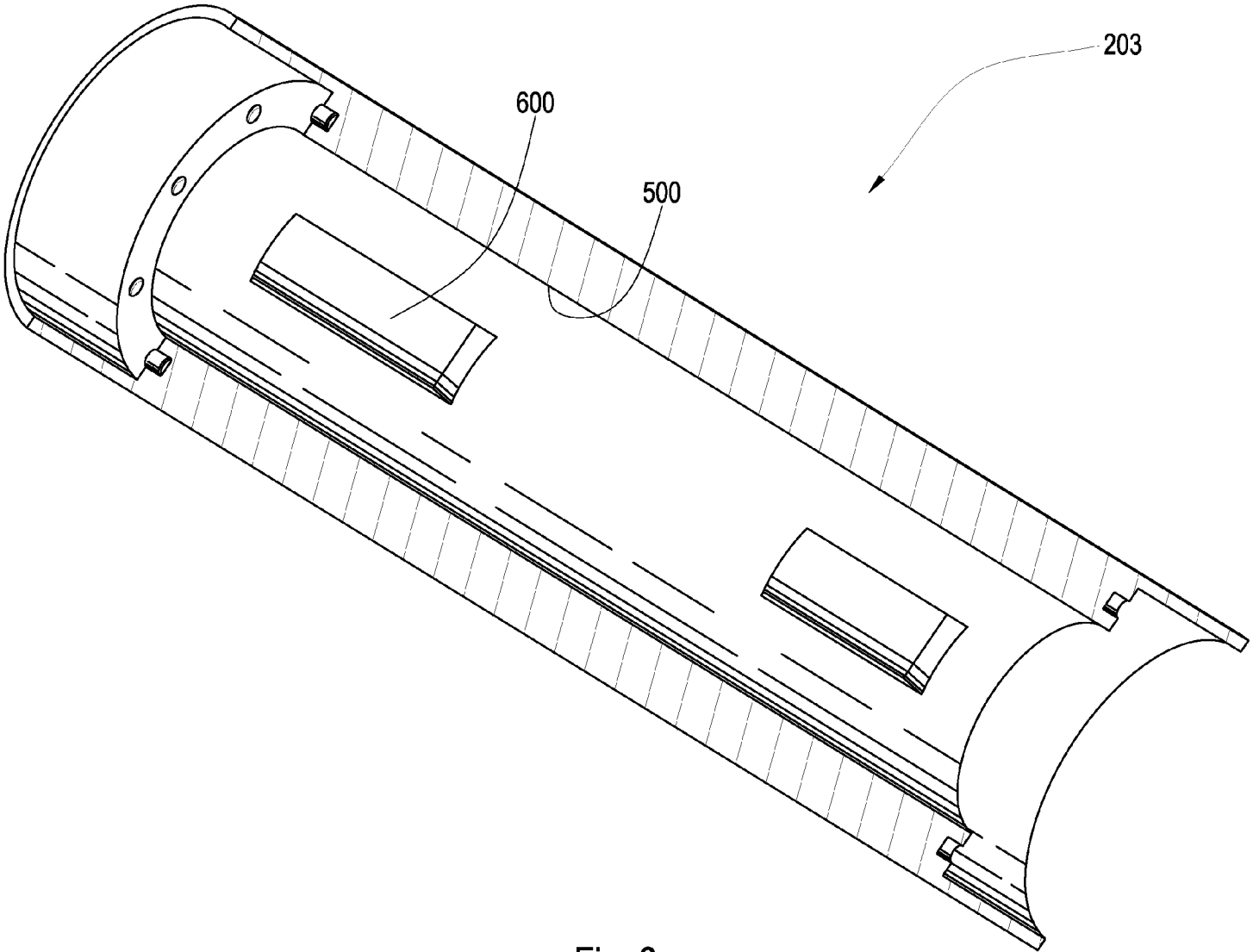
FIG. 6 is a perspective diagram of an embodiment of a sleeve.
Figure 7:
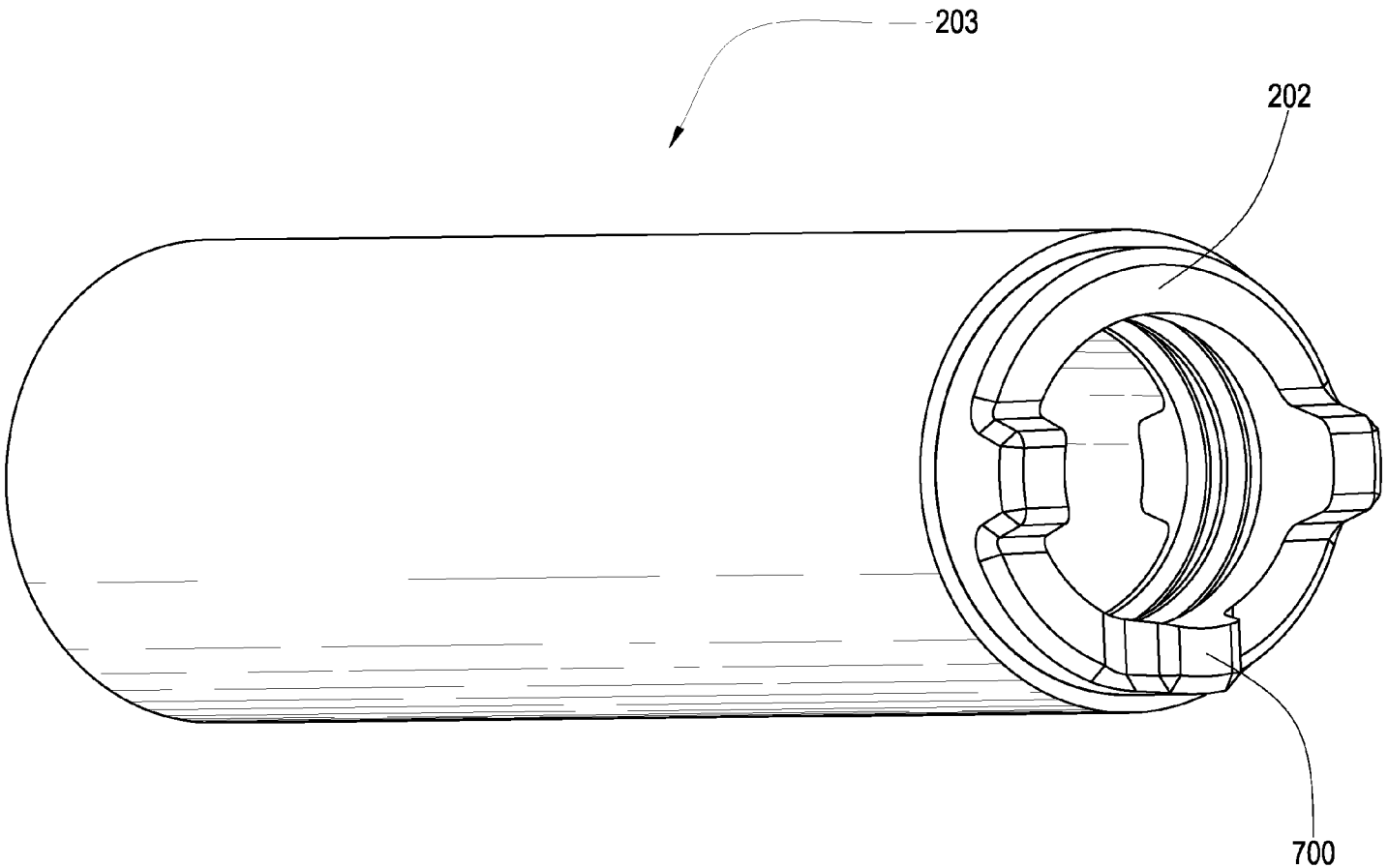
FIG. 7 is a perspective diagram of another embodiment of a sleeve.
Figure 8:
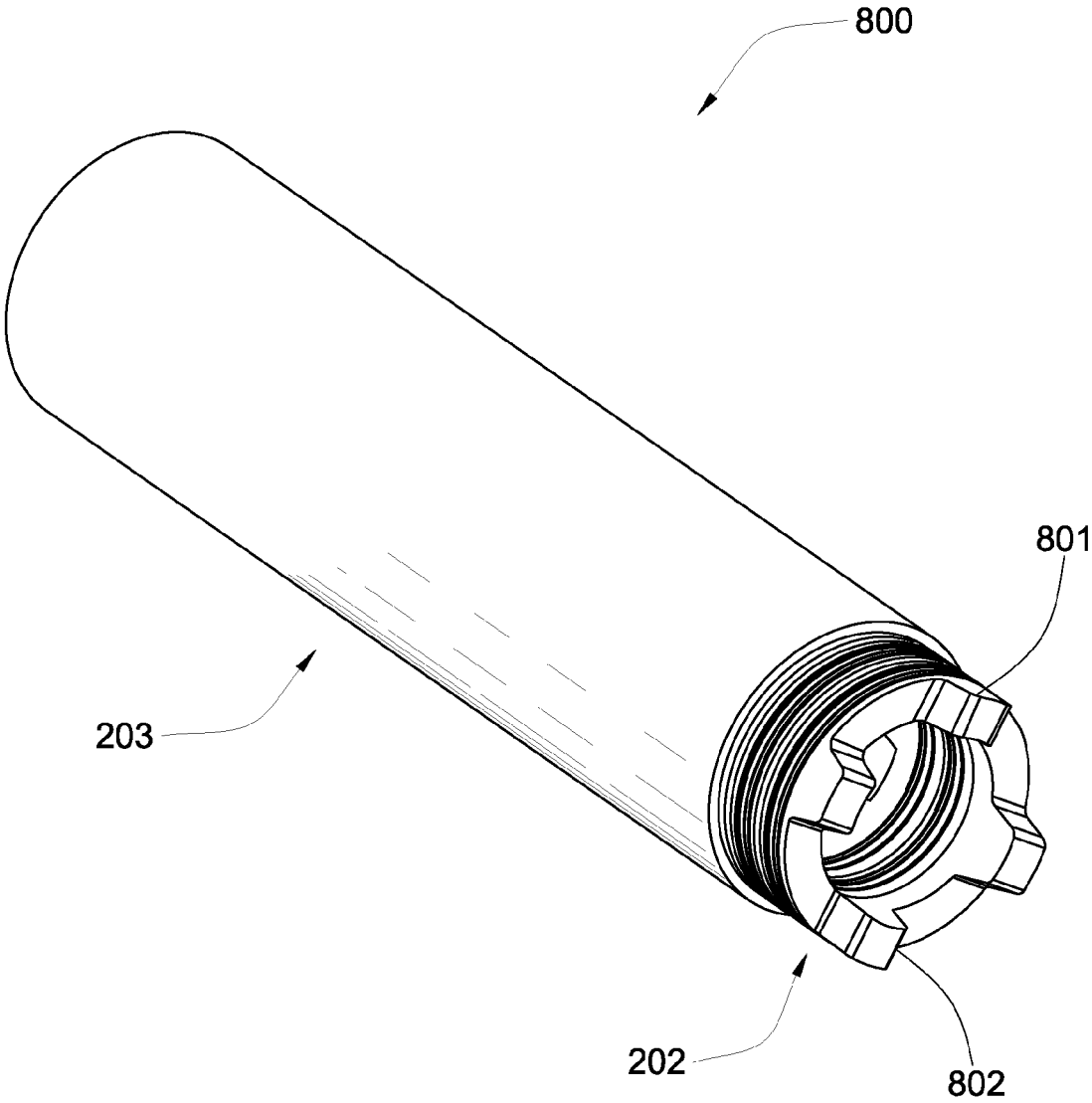
FIG. 8 is a perspective diagram of another embodiment of a sleeve.

A sleeve 203 may comprise a space 502 wherein the electronics housing 216 may be disposed, as in the embodiment of FIG. 5. The electronics housing 216 may be disposed within a portion of or all of an inner diameter 500 of the sleeve 203. A portion of the sleeve 203 and/or the electronics housing 216 may comprise bores 501 in which pins 305 may be inserted in order to key the sleeve 203 and/or housing 216 to a flange 202. The sleeve 203 may comprise recesses 600 within the inner diameter 500 wherein electronics or other elements may be disposed, as in the embodiment of FIG. 6. A flange 202 may comprise a series of lobes 700, as in the embodiment of FIG. 7. The sleeve 203 may be adapted to receive the lobes 700 such that the flange 202 provides torsional support for the sleeve 203. The flange 202 may also comprise lobes 700 on both ends or be adapted to receive lobes on both ends for connecting to a plurality of elements disposed around the component 200. A sleeve 203 and at least one flange 202 may be a single element 800, as in the embodiment of FIG. 8. The flange or sleeve may comprise a castle cut connection 801. An electronics housing 216 may also comprise a castle cut connection 801 on both ends in order to be secured to the sleeve and to receive a castle cut connection 801 from another element. The castle cut connection 801 may comprise rounded edges 802 to reduce stress risers in the connection A flange/sleeve combination element 800 may reduce the amount of time required to assemble, and it may also increase the torsional support for the sleeve 203. Another sleeve 203 may be adapted to be pressure fit around the flange 202 of the element 800 in order to create a proper seal surrounding the pocket.

Figure 9:
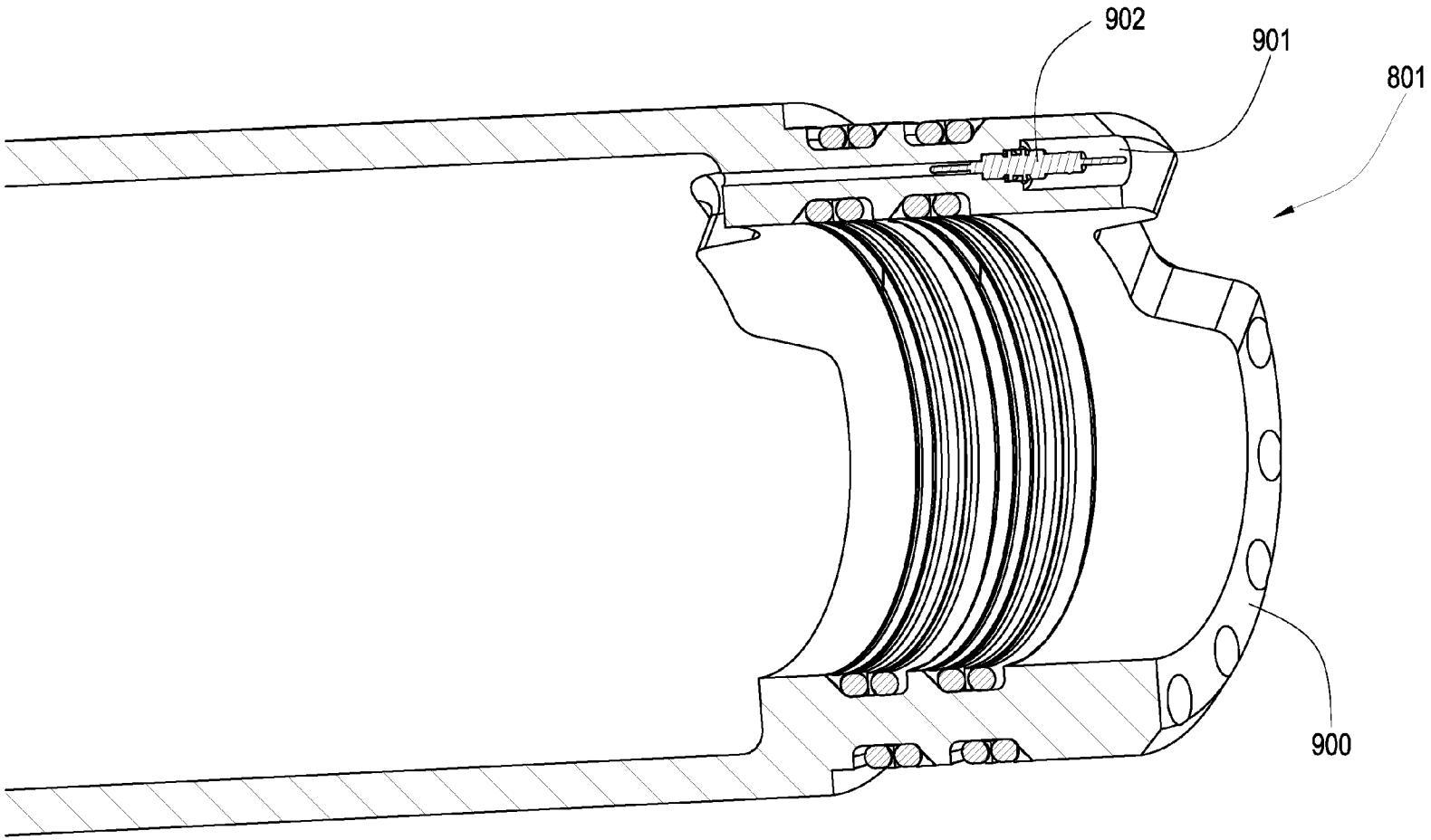
FIG. 9 is a perspective diagram of another embodiment of a sleeve.

The flange or sleeve may comprise a castle cut connection 801 wherein larger portions 900 of the connection protrude and the connection is adapted to receive smaller portions of another castle cut connection, as in the embodiment of FIG. 9. The flange may comprise at least one bore 901 wherein an electrical connector 902 may be disposed such that one pocket may be electrically connected with another pocket through a conduit or conduits disposed within the flange. The electrical connector 902 may be threaded into the bore 901 and may comprise a seal to prevent materials from passing through the bore 901.

Figure 10:
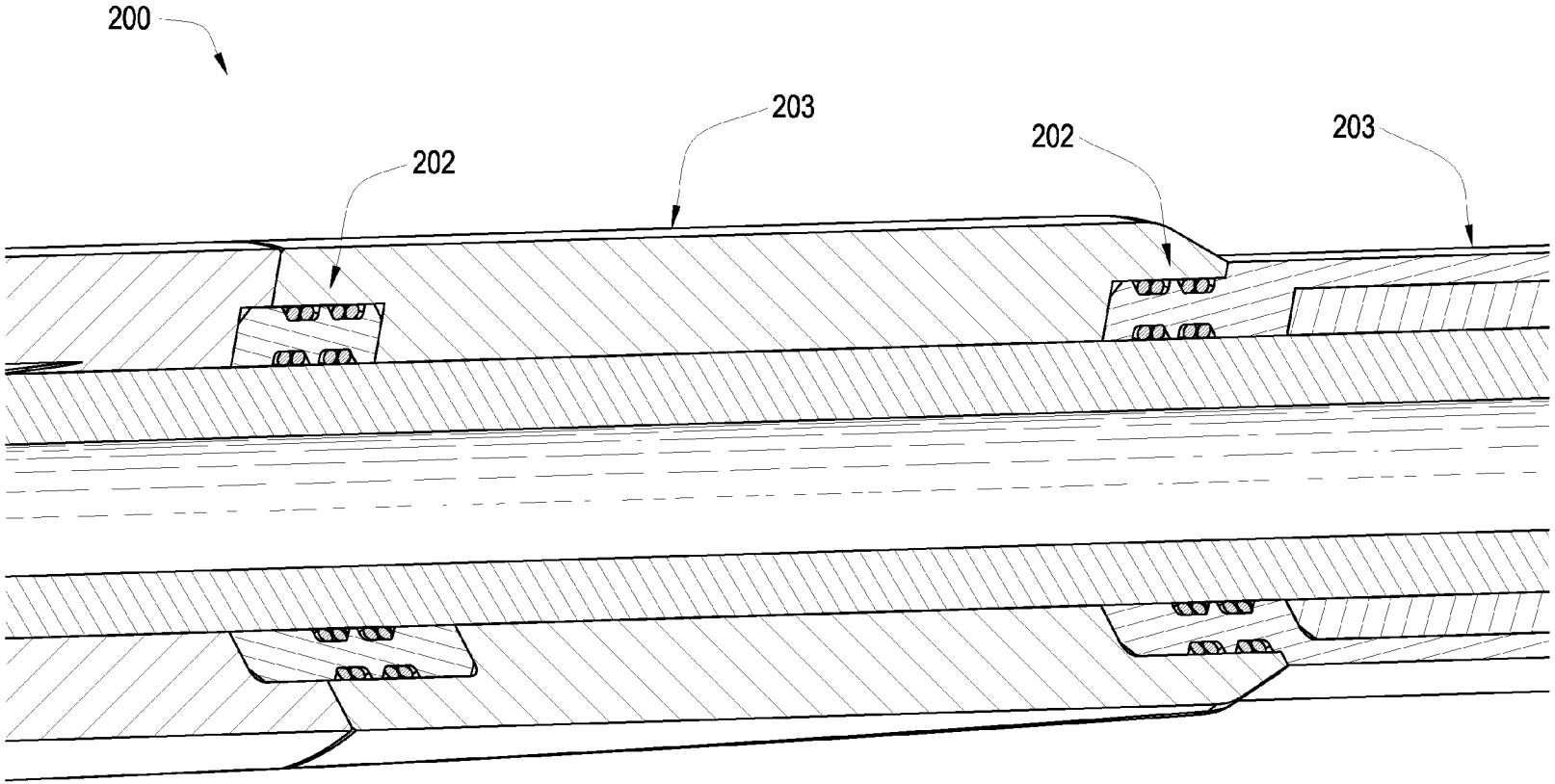
FIG. 10 is a perspective diagram of another embodiment of a sleeve.
Figure 11:
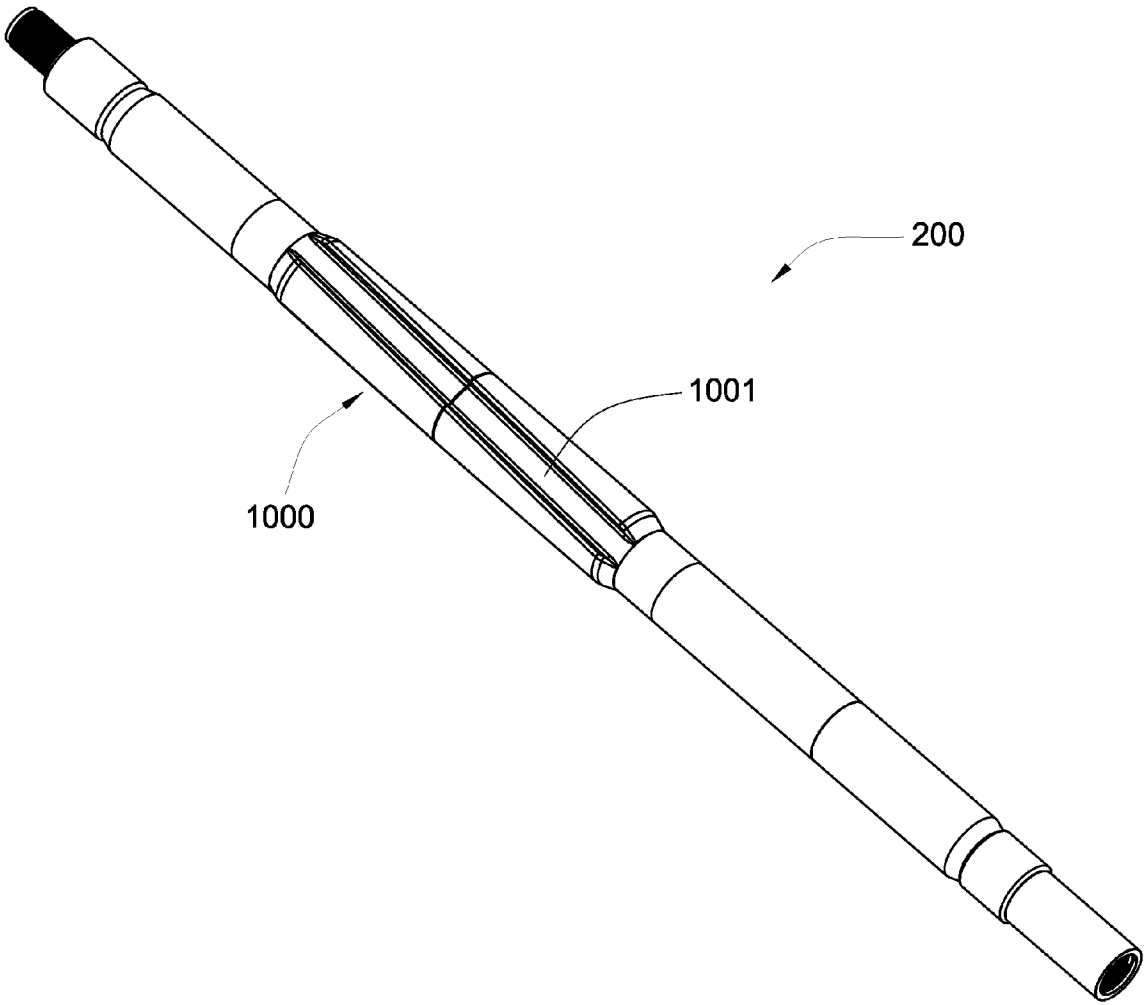
FIG. 11 is a perspective diagram of an embodiment of an electronics housing.

The component 200 may comprise a combination of flanges 202 which are separate from the sleeves 203 or combined with the sleeves 203, as in the embodiment of FIG. 10. Each may have advantages, depending on the type of sleeves 203 proximate the flange 202. The component 200 may comprise at least one sleeve which is a stabilizer 1000, as in the embodiment of FIG. 11. The stabilizer may comprise an outer geometry 1001 designed to stabilize the component and the drill string in the well bore while the drill string is in operation. The stabilizer 1000 may be adapted to contact the wall of the bore well. The stabilizer 1000 may also direct the flow of drilling fluid past the component.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a tubular body with an outer diameter;

a first, second, and third flange are disposed around the outer diameter of the tubular body at different axial locations;

a first sleeve disposed around the tubular body such that opposite ends of the first sleeve connect to at least a portion of the first and second flanges;

a second sleeve disposed around the tubular body such that opposite ends of the second sleeve connect to at least a portion of the second and third flanges; and at least one sleeve forming a pocket around the outer diameter of the tubular body;

wherein an end of at least one sleeve fits around a portion of at least one flange.

2. The component of claim 1, wherein the first pocket is electrically connected to a second pocket formed around the outer diameter of the tubular body by the second sleeve.

3. The component of claim 2, wherein the pockets are electrically connected through an electrically conductive conduit disposed within the second flange.

4. The component of claim 1, wherein at least one flange and at least one sleeve are a single element.

5. The component of claim 1, wherein the first and second sleeves are interlocked.

6. The component of claim 5, wherein the sleeves are interlocked with a castle cut connection.

7. The component of claim 1, wherein an electronics housing is disposed within at least one of the pockets.

8. The component of claim 7, wherein the electronics housing is interlocked with at least one flange.

9. The component of claim 7, wherein the electronics housing is interlocked with the tubular body.

10. The component of claim 1, wherein at least one pocket is sealed.

11. The component of claim 1, wherein the flanges comprise o-rings disposed along an outer diameter of the flanges.

12. The component of claim 1, wherein the flanges comprise o-rings disposed along an inner diameter of the flanges.

13. The component of claim 1, wherein the component also comprises a collar disposed around the tubular body at an end and adapted to be a primary shoulder of the component.

14. The component of claim 1, wherein at least one sleeve is a stabilizer adapted to stabilize the component in a well bore.

15. The component of claim 1, wherein the first sleeve abuts a shoulder formed in the outer diameter of the downhole component.

16. The component of claim 1, wherein at least one sleeve is made of a non-magnetic material.

17. The component of claim 1, wherein the component comprises a third sleeve disposed around the tubular body such that opposite ends of the third sleeve connect to at least a portion of the third flange and a fourth flange, forming another pocket around the outer diameter of the tubular body.

* * * * *